United States Patent [19]

Pelousse

[11] 4,052,942

[45] Oct. 11, 1977

[54] GRENADES PROVIDED TO BE LAUNCHED BY A BULLET

[75] Inventor: Jean A. Pelousse, Brussels, Belgium

[73] Assignee: "s.a.PRB", Société Anonyme, Brussels, Belgium

[21] Appl. No.: 689,683

[22] Filed: May 24, 1976

[30] Foreign Application Priority Data

May 29, 1975 Belgium ..... 254367

[51] Int. Cl.[2] ..... F42B 11/42

[52] U.S. Cl. ..... 102/65.2

[58] Field of Search ..... 102/65.2; 42/1 F

[56] References Cited

U.S. PATENT DOCUMENTS 1,900,790 3/1933 Brandt ..... 42/1 F 3,726,036 4/1973 Jennings et al. ..... 102/65.2

FOREIGN PATENT DOCUMENTS 604,510 1/1926 France ..... 102/65.2

1,578,125 9/1967 Germany ..... 102/65.2

*Primary Examiner*—Verlin R. Pendegrass

*Attorney, Agent, or Firm*—Bacon & Thomas

[57] ABSTRACT

Improvements to grenades to be launched by a bullet, of the type comprising at least one capturing part which is distorted by the stress of the driving bullet when the grenade is launched, characterized by the fact that aforesaid capturing part is conditioned so as to be stressed radially when the bullet passes through, without axial displacement in the direction of the movement of the bullet.

1 Claim, 2 Drawing Figures

GRENADES PROVIDED TO BE LAUNCHED BY A BULLET

Figure 1:
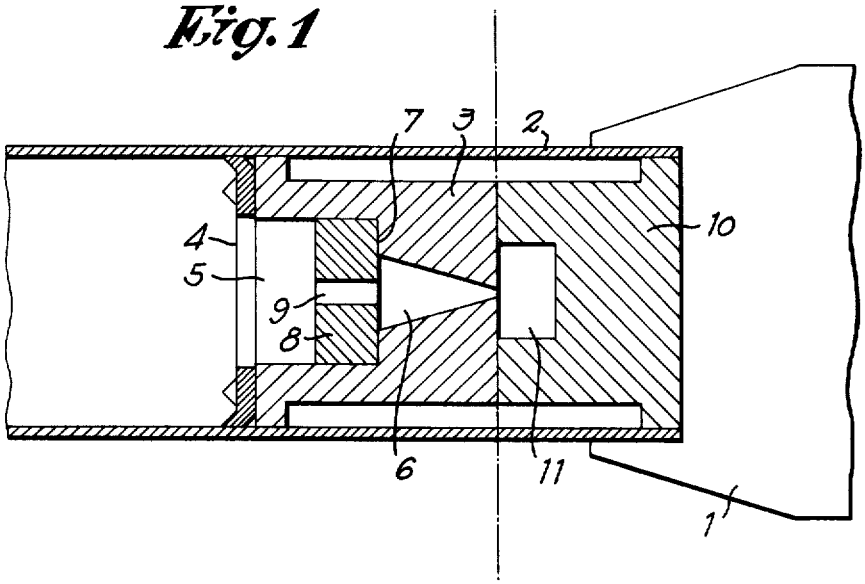

This invention concerns grenades which are provided to be bullet launched by means of a firearm. In this technique it is important to be able to control and influence the ballistic conditions of the moving body which assures the actual launching of the grenade. For this purpose, it has already been suggested to condition the latter in such a way, that it comprises, amongst others, a capturing part located in a tubular tail end, downstream of a conical passage, so that aforesaid capturing part is displaced axially, driven by the bullet, in a respectively predetermined and controlled manner. Aforesaid capturing part, cooperating with aforesaid conical passage, is conditioned in such a manner as to absorb part of the energy of the bullet by being distorted. For this purpose it has been recommended to shape aforesaid capturing part in a particular manner, in the present case, as a cylinder, provided on its peripheral surface with a certain number of annular grooves, thus forming a prepared distortion. Aforesaid capturing part is rendered integral with the tail tube of the grenade, usually by soldering, under circumstances which are such, that it can be liberated by the effect of the bullet impact. In whatever constructions which have been revealed to date, use is made of such a capturing part which is conditioned so as to offer the possibility of being simultaneously displaced axially and distorted by rolling in a conical passage.

It can be said of the devices known so far, that serious difficulties are encountered in determining the precise shape and dimensions, both of the capturing part itself as well as of the related elements which make up the actual launching device. These devices also offer the disadvantage of requiring a specifically appropriate choice of the materials used for the construction of the various elements of the launching device. Finally, the construction is rendered relatively delicate, due to the necessity of providing an appropriate attachment of the capturing part in the tubular tail piece of the grenade.

The purpose of the present invention consists of improvements based on a totally different conception of the idea itself of the capturing part. As opposed to the technique known up till now, a device is revealed by the present invention, which is indeed markedly simpler, both as far as construction is concerned, as regarding shaping of the various constituent parts, and mainly also, as far as assembly is concerned.

For this purpose, the improvements applied to the grenades provided for being bullet launched mainly consist of inserting into the tubular tail end of the grenade a centrally bored element which is engaged into a support piece having a central conical passage, said support piece being itself in permanent contact with the rear mass of the grenade, aforesaid conical passage leading into a blind bore provided in the adjacent surface of aforesaid rear mass of the grenade. By this arrangement it is obtained that aforesaid capturing part is stressed radially without being driven in axial movement, towards the head of the grenade, aforesaid capturing part being distorted by a marked increase in diameter of its central bore and by peripheral creep in the opposite sense to the movement of the grenade itself.

It can be seen, that the shaping of the constituent elements of the grenade improved in this manner is extremely simple and that the assembly of the corresponding part of the tubular tailpiece of the grenade is considerably simplified.

Figure 2:
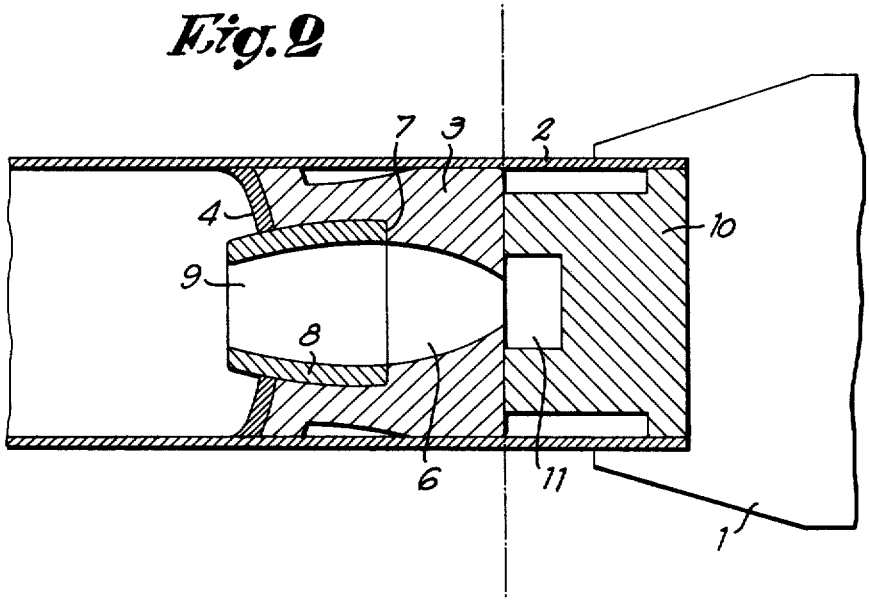

These novel characteristics may of course be put into effect in various shapes and dimensions, according to the type of grenade under consideration. Merely as a non-limiting example, a form of embodiment is described hereinafter, with reference to the appended drawings in which FIG. 1 shows a radial longitudinal section of the rear part of a grenade improved according to the invention;

FIG. 2 is similar to FIG. 1, but shows the grenade in its state when it has been stressed by the driving bullet.

In this form of embodiment, the grenade of any sort of type and which is shown in partial schematic view at 1, has a tubular tailpiece 2, conditioned so as to be able to be fitted in the known manner, for instance on the end of a rifle barrel or on the conditioned end piece of a flame-guard or of any other element provided to be attached to the end of the barrel of a fire-arm. In aforesaid cylindrical tailpiece, a support element 3 is inserted and maintained in position by an annular blocking ring 4. This element has a bore 5 which is extended by a conical hole 6, this arrangement being such, that an annular shoulder ledge 7 is formed in the support element against which the capturing part 8 is applied, which in this case consists of a simple cylindrical part of which the outer diameter is practically equal to the internal diameter of aforesaid bore 5. Aforesaid capturing part 8 has a central bore 9, the diameter of which is considerably smaller than that of the large base of conical passage 6. The support element 3 is extended by a mass of considerable resistance 10, which is in direct contact with the body of grenade 1 and is provided in its rear surface with a blind bore 11, into which leads the smaller diameter of above-mentioned conical passage 6.

This bore 11 provides the indispensable cavity required to prevent the slipping of materials which are still possessed with considerable energy.

The internal surface (bottom and wall) depends upon the Pascal pressure, acceptable limit of the elastic resistance of the metal of part 10.

This solution allows reduction of the mass of part 10 to a minimum.

As schematically shown in FIG. 2, after the bullet (not shown) has passed through, the capturing part 8 has been badly distorted by an important radial stress, in such a manner that the material has been driven outward and towards the rear, thus adopting, approximately, the shape shown schematically in FIG. 2. Support element 3 has also been distorted by the radial stress. Neither the capturing part 8, nor the support element 3 have shown any axial movement in the direction of the displacement of the driving bullet. By taking into consideration the shape and the dimensions of each of these constituent elements, it becomes easily possible to build the device so as to obtain an optimum efficiency. In this respect, any alteration of the shape and dimensions of aforesaid constituent parts is extremely simple to bring about, due to the very fact of the great simplicity of the constituent parts themselves and of their assembly operations.

What we claim is

1. In a grenade adapted to be launched by a bullet, of the type having at least one bullet capturing part which is distorted by the stress of the driving bullet when the grenade is launched, the improvement comprising a support element secured to said grenade;

a bore in said support element and having a shoulder against which said bullet capturing part is seated;

a conical hole in said support element, extending from said shoulder and tapering away from said bore, said bullet capturing part having an opening therethrough, of less diameter than the base of said conical bore adjacent said shoulder, said opening communicating directly with said conical bore; and the small diameter end of said conical bore, remote from said shoulder, communicating with a blind chamber, of greater diameter than said small diameter end.

* * * * *